United States Patent [19]

Szu et al.

[11] Patent Number: 4,884,586

[45] Date of Patent: Dec. 5, 1989

[54] RIB COUPLING FOR HAT-LIKE UMBRELLAS

[76] Inventors: Tseng Szu, No. 6, Niu-P'u Road, Hsin-Chu City, Taiwan; Tadashi Shimizu, Harada chō 3-3-31, Toyonaka-shi, Ōsaka, Japan

[21] Appl. No.: 276,687

[22] Filed: Nov. 28, 1988

[51] Int. Cl.[4] ..... A45B 11/00

[52] U.S. Cl. ..... 135/26; 135/29; 135/20 R

[58] Field of Search ..... 135/25 A, 29, 20 R, 135/26

[56] References Cited

U.S. PATENT DOCUMENTS

| | | | |
|---|---|---|---|
| 182,233 | 9/1876 | Shaw | 135/26 |
| 954,357 | 4/1910 | Susemihl | 135/26 |
| 4,105,039 | 8/1978 | Schultes et al. | 135/25 A |

FOREIGN PATENT DOCUMENTS

| | | | |
|---|---|---|---|
| 560714 | 10/1923 | France | 135/20 R |
| 18877 | of 1891 | United Kingdom | 135/20 R |
| 2191395 | 12/1987 | United Kingdom | 135/20 R |

*Primary Examiner*—David A. Scherbel

*Assistant Examiner*—Caroline D. Dennison

*Attorney, Agent, or Firm*—Lahive & Cockfield

[57] ABSTRACT

A coupling device for a hat-like umbrella frame consisting of a coupling member and a rib stretcher. A visor rib comprising an outer segment with a smaller diameter than the inner segment thereof is pivotably connected to a main rib and a respective rib stretcher. The coupling member is substantially U-shaped with an opening at one end thereof. The coupling member is disposed between the rib stretcher and the visor rib for allowing the visor rib to pass through. The outer segment of the visor rib is freely slidable within the opening of the coupling member. The inner segment of the visor rib is unable to pass through the opening member so that a sliding movement between the visor rib and the coupling member will be stopped. When opening the umbrella, the visor rib is movable outwardly and downwardly until the inner segment of the visor rib is stopped by the coupling member to become substantially horizontal and the main rib is stopped to further move outwardly and upwardly due to the connection between the visor rib and the main rib.

1 Claim, 5 Drawing Sheets

RIB COUPLING FOR HAT-LIKE UMBRELLAS

BACKGROUND OF THE INVENTION

This invention relates to improvements in hat-like umbrellas and in particular to the rib coupling between the main frame and the visor rib.

A hat-like umbrella consists of a regular umbrella and a visor attached thereon. Traditionally, the coupling element between the main frame and the visor rib is fixed on the visor rib. Therefore, when the hat-like umbrella is open or closed, the deformation of the main rib will stress the umbrella cover greatly. It is thus possible to tear the cover. Another drawback is that it takes greater effort to open the umbrella and to make the visor horizontal because of the tension in the cover and the main rib.

It is therefore an object of the present invention to provide an improved coupling element between the main rib and the visor rib which may obviate and mitigate the above mentioned drawbacks.

SUMMARY OF THE INVENTION

This invention is directed to an improved visor coupling of a hat-like umbrella.

It is the primary object of the present invention to provide a visor coupling for a hat-like umbrella which can reduce the tension in the umbrella cover and ribs, thus reducing possible damage to the umbrella.

It is another object of the present invention to provide a visor coupling for a hat-like umbrella which makes it possible to take less effort to open or close the umbrella, and it is thus possible to have a hat-like umbrella with a more simple structure than the prior art.

DETAILED DESCRIPTION OF THE INVENTION

For purpose of promoting an understanding of the invention, reference will be made to the embodiments illustrated in drawings. It will, nevertheless, be understood that no limitation of the scope of the invention is thereby intended, such alternatives and further modifications in the illustrated device and such further applications of the principles of the invention as illustrated herein being contemplated as would normally occur to one skilled in the art to which the invention relates.

Figure 1:
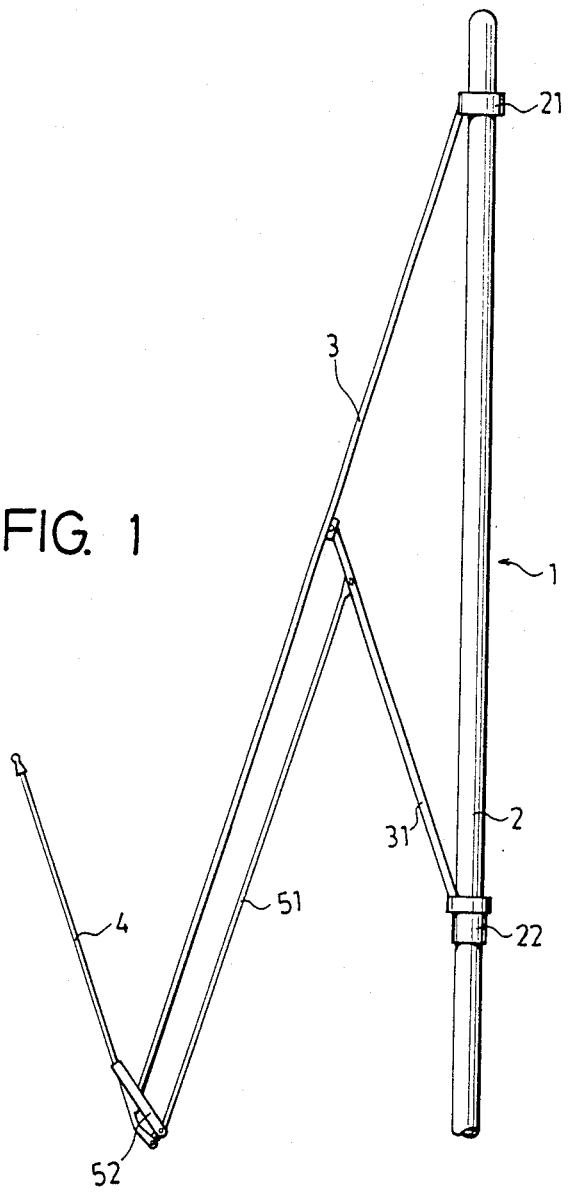
FIG. 1 is a side view of the frame of a hat-like umbrella.

Referring to FIG. 1, the frame 1 of a hat-like umbrella consists of a telescoping stick 2, a plurality of main ribs 3 and main stretchers 31, a plurality of visor ribs 4 and a coupling device. The attachment of the stick 2 to the main ribs 3 and the main stretchers 31 may be in any known manner. Usually, the main rib 3 radiates from a crown 21 disposed on one end of the stick 2 and the main stretcher 31 radiates from a runner 22 slidably mounted on the stick 2. The main stretcher 31 is also pivotedly connected to a suitable position on the main rib 3. The main stretcher 31 moves the main rib 3 upwards or downwards to open or close the umbrella with the movement of the runner 22. The visor rib 4 is connected to the main rib 3 via the coupling device. The coupling device is so arranged that when the umbrella is fully open, the visor will be horizontally positioned and when the umbrella is closed, the visor moves toward the stick 2, and finally substantially in parallel with the stick 2.

Figure 2:
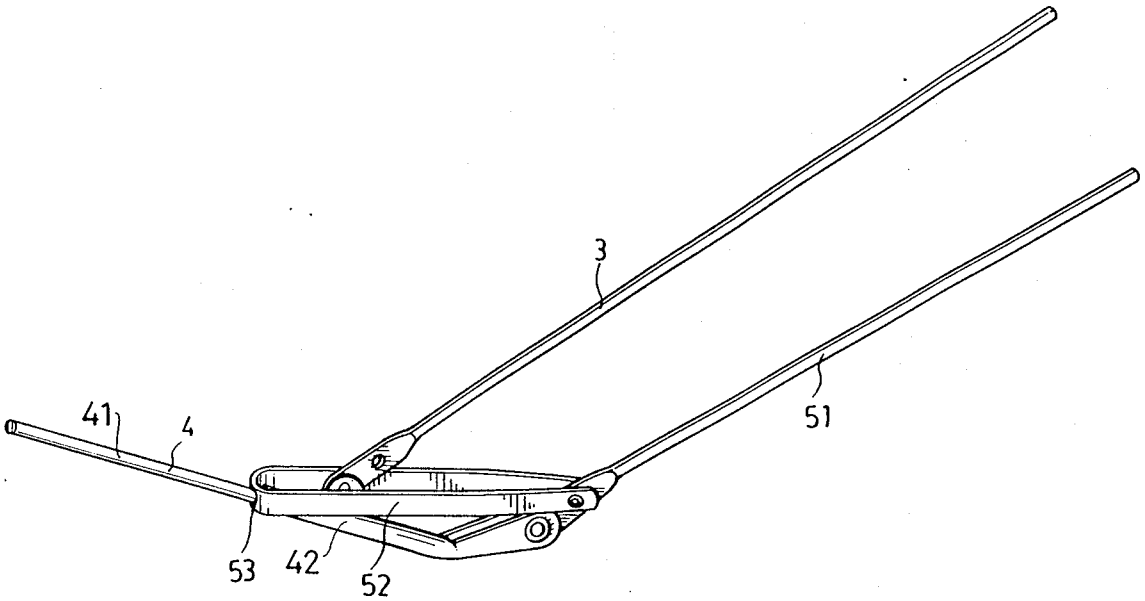
FIG. 2 is a fragmentary view drawn to a larger scale showing the coupling structure.
Figure 3:
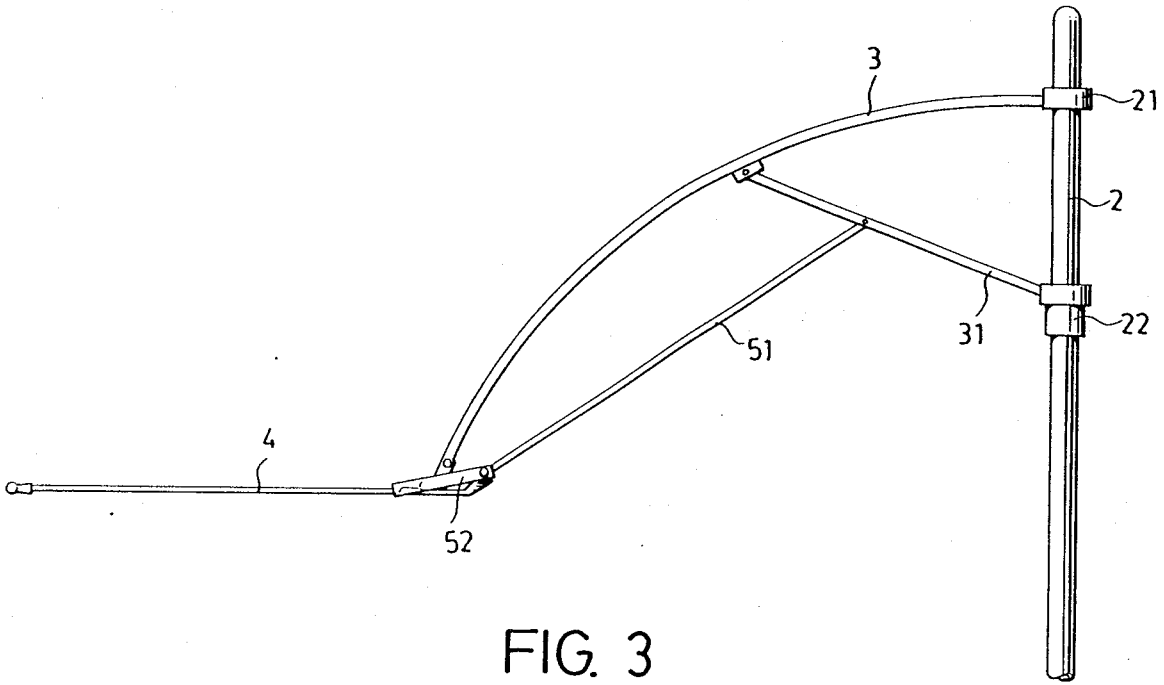
FIG. 3 is a side view showing the frame in a fully open position.

The coupling device is more clearly shown in FIG. 2. The coupling device consists of a visor stretcher 51 and a coupling member 52. The visor stretcher 51, with one end hinged to the main stretcher 31, is pivotedly connects to the visor rib 4. At a suitable distance from the connection of the visor rib 4 and the visor stretcher 51, the main rib 3 is hinged to the visor rib 4. The coupling member 52 is, in general, U-shaped with an opening 53 at one end thereof for allowing the visor rib 4 to pass through. As shown in FIG. 2, the visor rib 4 has an outer segment 41 with a smaller diameter than the inner segment 42 thereof. The two segments 41 and 42 are either integral or composed of different elements which are fixedly connected. The outer segment 41 of the visor rib 4 is insertable through the opening 53 so that, when opening the umbrella, a further relative sliding movement between visor rib 4 and the coupling member 52 will be stopped. The opposite end of the coupling member 52 is hinged to the visor stretcher 51 at a position adjacent to the connection point between the visor rib 4 and the visor stretcher 51. The length of the coupling member 52 is such that when opening the umbrella, the visor rib 4 moves outwardly and downwardly until the inner segment 42 thereof is stopped by the coupling member 52 and become substantially horizontal. At the same time, the outward and upward movement of the main rib 3 is also stopped due to the connection between the visor rib 4 and the main rib 3. When completing the opening operation, the coupling member 52 and the main rib 3 become tensioned and the main rib 3 will exhibit a concave arc relative to main stretcher 31, as shown in FIG. 3.

Figure 4:
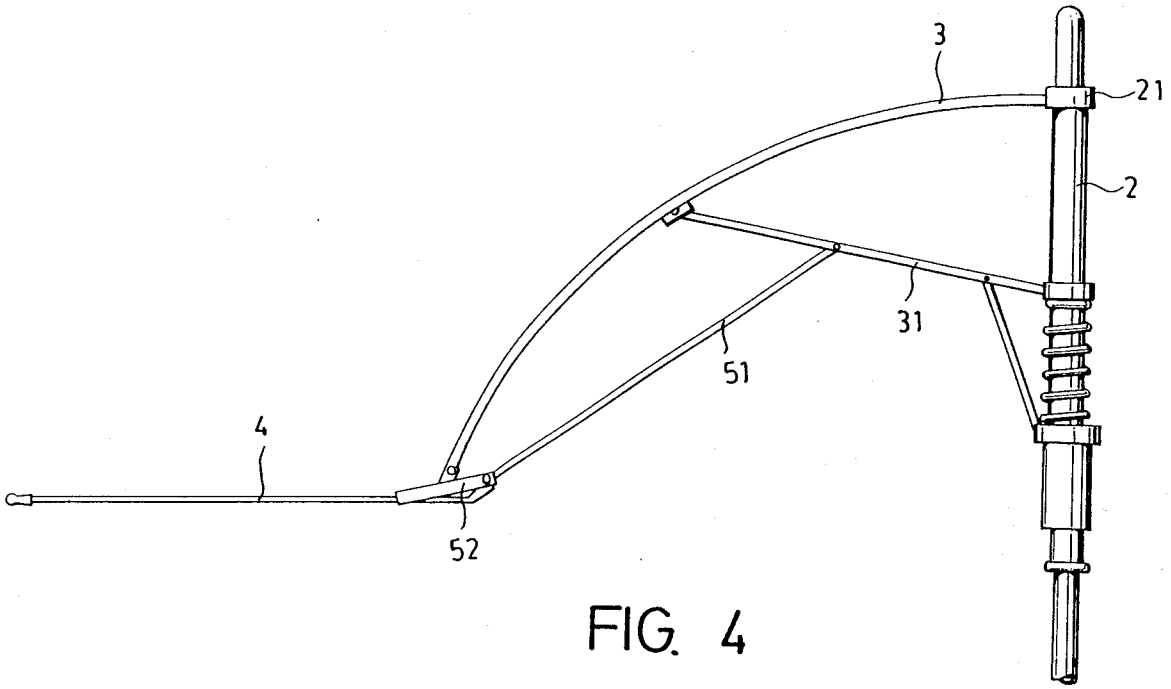
FIGS. 4 and 5 show two applications of the present invention in an automatic umbrella.
Figure 5:
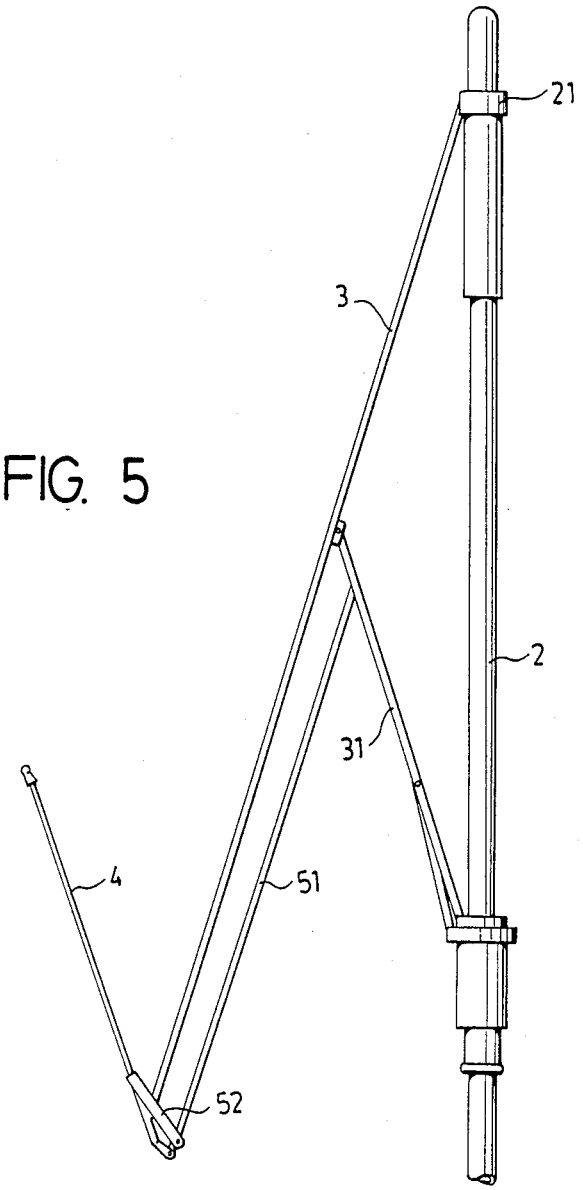

The coupling device can also be applied to an automatic umbrella, as shown in FIG. 4. Since the principle is the same as that has been described hereinbefore, it will not be further described herein.

We claim:

1. A hat-like umbrella frame comprising a stick, a plurality of main ribs radiating from a crown which is disposed on the stick, said main ribs being interconnected by a plurality of main stetchers with a runner slidable on the stick, a plurality of rib stretchers having one end hinged to at least some of said main stretchers and having another end coupled with a free end of at least some of said main ribs and a respective visor rib by a respective coupling member;

said visor rib being composed of an outer segment with a smaller diameter than an inner segment thereof, said rib stretcher and said main rib being pivotally connected to said inner segment of said visor rib;

said coupling member being substantially U-shaped with an opening at one end thereof for allowing said visor rib to pass through, another end of said coupling member being hinged to said rib stretcher at a position adjacent to the connection point between said visor rib and said rib stretcher, said outer segment of said visor rib being slidable within said opening of said coupling member, said inner segment of said visor rib being unable to pass through said opening of said coupling member so that a sliding movement between said visor rib and said coupling member will be stopped; and said visor rib being movable outwardly and downwardly until said inner segment thereof is stopped by said coupling member to become substantially horizontal and said main rib being stopped to move outwardly and upwardly due to the connection between said visor rib and said main rib when opening the umbrella.

* * * * *